United States Patent [19]

Idota

[11] Patent Number: 4,526,857

[45] Date of Patent: Jul. 2, 1985

[54] IMAGE FORMATION BY SILVER SALT DIFFUSION TRANSFER PROCESS COMPRISING MERCAPTOTRIAZOLE AND THIOURACIL

[75] Inventor: Yoshio Idota, Minami-ashigara, Japan

[73] Assignee: Fuji Photo Film Co., Ltd., Kanagawa, Japan

[21] Appl. No.: 599,446

[22] Filed: Apr. 12, 1984

[30] Foreign Application Priority Data

Apr. 20, 1983 [JP] Japan ..... 58-69781

[51] Int. Cl.[3] ..... G03C 5/54; G03C 1/10

[52] U.S. Cl. ..... 430/248; 430/233; 430/250; 430/611

[58] Field of Search ..... 430/233, 250, 248, 965

[56] References Cited

U.S. PATENT DOCUMENTS

| | | | |
|---|---|---|---|
| 2,857,274 | 10/1958 | Land et al. | 430/251 |
| 2,857,275 | 10/1958 | Land et al. | 430/251 |
| 2,857,276 | 10/1958 | Land et al. | 430/251 X |
| 3,017,270 | 1/1962 | Tregillus et al. | 430/233 X |
| 3,287,124 | 11/1966 | Green et al. | 430/250 |
| 3,287,125 | 11/1966 | Green et al. | 430/250 |
| 3,293,034 | 12/1966 | Green et al. | 430/250 |
| 3,307,944 | 3/1967 | Weyde et al. | 430/248 |
| 3,671,242 | 6/1972 | Liebe et al. | 430/248 |
| 3,756,825 | 9/1973 | Rickter | 430/233 X |
| 3,856,520 | 12/1974 | Bloom et al. | 430/611 X |
| 4,002,479 | 1/1977 | Suzuki et al. | 430/619 X |
| 4,123,274 | 10/1978 | Knight et al. | 430/347 X |
| 4,128,557 | 12/1978 | Knight et al. | 430/619 X |
| 4,137,079 | 1/1979 | Houle | 430/611 X |
| 4,138,265 | 2/1979 | Shiao | 430/619 X |
| 4,220,709 | 9/1980 | de Mauriac | 430/619 X |
| 4,436,805 | 3/1984 | Iguchi et al. | 430/248 |

FOREIGN PATENT DOCUMENTS

| | | | |
|---|---|---|---|
| 972063 | 10/1964 | United Kingdom | 430/233 |

*Primary Examiner*—John E. Kittle
*Assistant Examiner*—Mukund J. Shah
*Attorney, Agent, or Firm*—Brumbaugh, Graves, Donohue & Raymond

[57] ABSTRACT

In a process of forming an image by silver salt diffusion transfer comprising using a processing composition containing an alkali, a hydroxylamine developing agent, and a silver halide solvent, this process of forming an image comprises performing the diffusion transfer in the presence of a compound represented by the general formula:

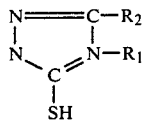

or both this compound and a compound represented by the general formula:

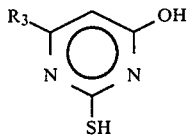

16 Claims, No Drawings

IMAGE FORMATION BY SILVER SALT DIFFUSION TRANSFER PROCESS COMPRISING MERCAPTOTRIAZOLE AND THIOURACIL

BACKGROUND OF THE INVENTION

1. Field of the Invention

This invention relates to a process of forming an image by silver salt diffusion transfer.

The process of forming an image by diffusion transfer using a silver salt such as a silver halide is well-known. In a general example thereof, the procedure of the process is as follows. An exposed photosensitive silver halide emulsion layer is first processed with an aqueous alkaline solution containing a developing agent and a silver halide solvent. The exposed silver halide grains are reduced to silver by the developing agent, while the unexposed silver halide grains are converted to a transferable silver complex salt by the silver halide solvent. This silver complex salt is diffused and transferred by inhibition to a layer containing silver-precipitating nuclei (an image-receiving layer) laid over the emulsion layer, where the silver complex salt is reduced by the developing agent with the aid of the silver-precipitating nuclei, to provide a silver image.

When practicing this process, use is usually made of a film unit which comprises a combination of (i) a photosensitive element containing a layer of photosensitive silver halide emulsion on a support, (ii) an image-receiving element which include an image-receiving layer containing silver-precipitating nuclei on a support, and (iii) a processing element which consists of breakable containers which hold a viscous aqueous alkaline solution containing a developing agent, a silver halide solvent, and a thickener. The emulsion layer of the photosensitive element (i) is first exposed, then the photosensitive element is placed over the image-receiving element in such a way that the emulsion layer is against the image-receiving layer of the image-receiving element (ii), and these layers are passed between a pair of rollers so that the processing element (iii) is broken and the viscous aqueous alkaline solution it contains can spread, and are then allowed to stand for a predetermined time. The image-receiving element (ii) is then peeled off the photosensitive element (i) to provide a print comprising the image-receiving layer in which the desired image has been formed.

2. Description of the Prior Art

However, during this process of diffusion transfer using a silver salt such as a silver halide, the silver image is known to exhibit a color which is not black, but is brown or some other unacceptable color. In order to eliminate this drawback, a variety of toning agents are used. 1-phenyl-5-mercapto-1,2,3,4-tetrazole is known as a typical example of such a toning agent. In addition to this, S-substituted pyrimidine derivatives as described in U.S. Pat. No. 3,756,825 are known, and their use can provide a dark-blue image of a high optical density.

However, techniques of this kind can not be said to be complete as yet, and there is room for improvement therein.

As a result of extensive studies aimed at further improving the tone of a silver image formed by the diffusion transfer process using a silver halide, the present inventors have devised this invention. Namely, we have found that the use of mercapto-triazole or a derivative thereof as a toning agent is effective for improving the tone, and have succeeded in further improving the tone of the silver image of the prior art.

SUMMARY OF THE INVENTION

This invention relates to a process of forming an image by silver salt diffusion transfer using a specific toning agent.

It is a primary object of this invention to provide a novel processing solution composition which has an excellent toning effect.

It is another object of this invention to provide a novel processing solution composition which has an excellent toning effect and a high sensitivity.

It is still another object of this invention to provide a process of forming an image by diffusion transfer using this processing solution and a film unit therefor.

The above objects and other various objects of this invention can be achieved by using a mercapto-triazole compound of general formula (I) as a toning agent.

General formula (I)

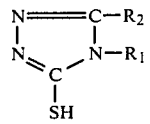

(I)

where $R_1$ is a hydrogen atom; an alkyl group of 1 to 6 carbon atoms which are not substituted or are substituted by halogens, $R_9CONH$— (where $R_9$ is an aryl group, or an alkyl group of 1 to 6 carbon atoms), or aryl groups; an alkenyl group of 1 to 6 carbon atoms; —SH; —$SR_4$ (where $R_4$ is an alkyl group of 1 to 3 carbon atoms); —OH; or —$N(R_5)_2$ (where $R_5$ is a hydrogen atom or an alkyl group of 1 or 2 carbon atoms); and $R_2$ is a hydrogen atom; an alkyl group of 1 to 6 carbon atoms which are not substituted or are substituted by halogens, $R_9CONH$— (where $R_9$ is an aryl group, or an alkyl group of 1 to 6 carbon atoms), or aryl groups; an alkenyl group of 1 to 6 carbon atoms; an aryl group; —$NH_2$; an aryl group which is substituted by $R_7CONH$— (where $R_7$ is an alkyl group of 1 or 2 carbon atoms), —$NO_2$, a halogen atom, $OR_8$ (where $R_8$ is an alkyl group with 1 or 2 carbon atoms), —COOH, or —$SO_3H$; —OH; —SH; or

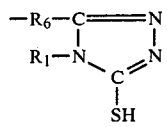

(where $R_6$ is an alkylene group of 2 to 6 carbon atoms).

Namely, this invention relates to a processing composition prepared by adding at least one compound of general formula (I) as a toning agent to the processing element (iii) which contains a hydroxylamine developing agent, a silver halide solvent, and an alkali.

The use of the toning agent of the processing composition of this invention, that is, a compound of general formula (I), as an antifoggant is known conventionally. However, its use as a toning agent is not known.

Examples of the compounds of general formula (I) are set forth below.

(i)

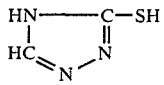

(ii)

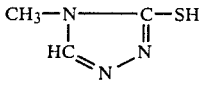

(iii)

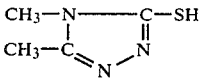

(iv)

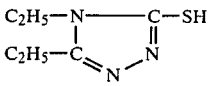

(v)

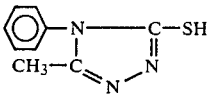

(vi)

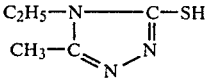

(vii)

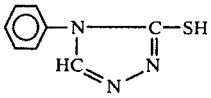

(viii)

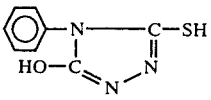

(ix)

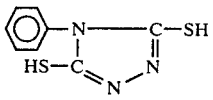

(x)

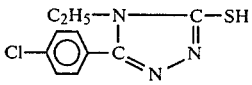

(xi)

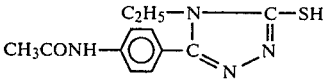

(xii)

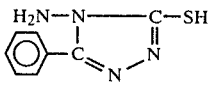

(xiii)

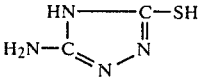

(xiv)

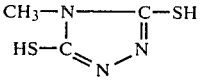

(xv)

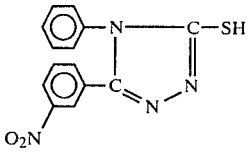

-continued (xvi)

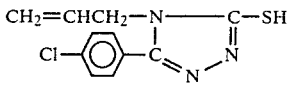

(xvii)

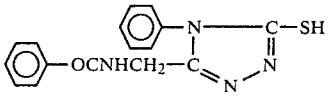

(xviii)

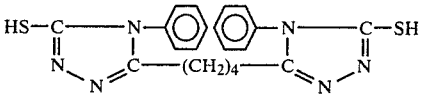

In general, a toning agent can also function as an inhibitor, a sensitizer or the like. It is therefore difficult, in most cases, to alter the tone alone, without affecting the sensitivity, fogging, stability, etc., as well.

It has been found that, depending on the kind of compound used, even the toning agent of this invention produces a decrease in sensitivity in practical use.

It is possible, however, to avoid this drawback by using this toning agent together with a compound of the following general formula (II):

(II)

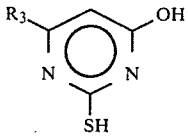

where $R_3$ is a hydrogen atom or an alkyl group of 1 to 6 carbon atoms.

The compound of general formula (II) does not exhibit any toning effect when it is used alone. Preferable examples of the compounds of this kind include those in which $R_3$ is (a) a hydrogen atom, (b) $CH_3$, and (c) n—$C_3H_7$.

When $R_3$ in general formula (II) has more than 6 carbon atoms, the compound causes a decrease in the maximum concentration, which is not desirable.

In this invention, it is also possible to add the compounds of general formulas (I) and (II) to the image-receiving element (ii) and still obtain the same effect.

In this invention, when the compound of general formula (I) is added to the processing element, the quantity of it added is preferably $1\times10^{-5}$ to $1\times10^{-1}$M/l, more preferably $1\times10^{-4}$ to $5\times10^{-2}$M/l, and even more preferably $1\times10^{-3}$ to $1\times10^{-2}$M/l. When the compound is added to the image-receiving element (ii), the quantity added is preferably $10^{-8}$ to $10^{-3}$M/m$^2$, more preferably $10^{-7}$ to $10^{-4}$M/m$^2$, and even more preferably $10^{-6}$ to $10^{-5}$M/m$^2$.

On the other hand, when the compound of general formula (II) is added to the processing element, the quantity of it added is preferably $1\times10^{-5}$ to $1\times10^{-1}$M/l, more preferably $1\times10^{-4}$ to $5\times10^{-2}$M/l, and even more preferably $5\times10^{-4}$ to $1\times10^{-2}$M/l. When the compound is added to the image-receiving element (ii), the quantity added is preferably $1\times10^{-6}$ to $1\times10^{-2}$, more preferably $5\times10^{-6}$ to $5\times10^{-3}$M/m$^2$, and even more preferably $1\times10^{-5}$ to $1\times10^{-3}$M/m$^2$.

The hydroxylamine developing agent used in the processing composition of this invention, when used in combination with a silver image-receiving layer of regenerated cellulose, is particularly useful in forming a silver transferred image which requires no or almost no after-treatment.

Examples of particularly useful hydroxylamine developing agents include N-alkyl- and N-alkoxyalkyl-substituted hydroxylamines. Hydroxylamines of this kind are described in U.S. Pat. Nos. 2,857,274, 2,857,275, 2,857,276, 3,287,124, 3,287,125 and 3,293,034.

Hydroxylamine developing agents which are particularly effective and desirable can be represented by the general formula:

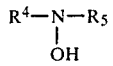

where $R^4$ is an alkyl, alkoxyalkyl, or alkoxylalkoxyalkyl group, and $R^5$ is a hydrogen atom, or an alkyl, alkoxyalkyl, alkoxyalkoxyalkyl, or alkenyl group. Each of the alkyl, alkoxy and alkenyl groups preferably have 1 to 3 carbon atoms.

Examples of particularly useful hydroxylamine developing agents include N,N-diethylhydroxylamine, N,N-bis-methoxyethylhydroxylamine, and N,N-bis-ethoxyethylhydroxylamine.

The quantity of this hydroxylamine developing agent used is 0.01 to 1.0M, preferably 0.05 to 0.5M, more preferably 0.1 to 0.3M per liter of processing solution.

The silver halide solvents used in this invention can be alkali metal thiosulfates, for example, sodium thiosulfate or potassium thiosulfate.

Preferable examples of these are cyclic amides, such as uracil, urazol, and 5-methyluracil described in detail in the cited U.S. Pat. Nos. 2,857,274, 2,857,275 and 2,875,276.

In the processing solution composition of this invention, the quantity of silver halide solvent used is 0.05 to 1.0M, preferably 0.1 to 0.8M, more preferably 0.2 to 0.6M per liter of processing solution.

It is also preferable to use an alkali metal hydroxide, such as sodium hydroxide or potassium hydroxide, as the alkali. The quantity used is 0.2 to 5M/l, preferably 0.5 to 4M/l.

When the composition of this invention is used by being spread as a thin layer between the photosensitive element (i) and the image-receiving element (ii) laid thereupon, especially when it is distributed in such a way after these elements have been laid one on the other, it is preferable that the processing solution composition contains a polymer film-forming agent and a concentrator or thickener. For this purpose, hydroxyethylcellulose and sodium carboxymethyl-cellulose are particularly useful. These are added to the processing solution in a concentration which is effective for providing a suitable viscosity, by principles well-known in the art of diffusion transfer photography. It is also possible to add other aids, such as antifoggants, other toning agents, and stabilizers, that are well-known for the silver transfer process. In particular, an effective way of increasing the activity of the processing solution is to add a hyroxylethylamino compound, such as triethanolamine. (See U.S. Pat. No. 2,857,276.)

In this invention, the processing element (iii) is preferably contained in breakable containers. These breakable containers and their materials may be anything that is well-known, as described in detail in U.S. Pat. Nos. 3,056,491, 3,056,492, 3,173,580, 3,750,907, 3,833,381, 4,303,750, 4,303,751, etc.

The image-receiving element (ii) of this invention comprises a support which includes an image-receiving layer containing a silver-precipitating agent (e.g., a layer of regenerated cellulose). This support can be any well-known one, for example baryta paper, cellulose triacetate, polyester, etc., can be used.

The image-receiving element (iii) will now be described in more detail. The support is first coated with a coating solution containing a dispersed silver-precipitating agent. The coating solution could be, for example, a cellulose ester, in particular cellulose diacetate. If necessary, the support can be treated to form a substratum. The thus-obtained cellulose layer is then hydrolyzed by treatment with an alkali to convert at least the surface in the depthwise direction of the cellulose ester into regenerated cellulose. This is used as the image-receiving layer. In a particularly useful embodiment, the unhydrolyzed portion of the cellulose ester layer containing cellulose diacetate may include one or more mercapto compounds which are suitable for improving the tone, stability, and other photographic properties of the silver-transfer image. These mercapto compounds diffuse from their initial position during the inhibition. An image-receiving element of this type is described in U.S. Pat. No. 3,607,269.

Examples of the modified silver-precipitating agents used in this invention include heavy metals, such as iron, lead, zinc, nickel, cadmium, tin, chromium, copper, and cobalt, and in particular noble metals such as gold, silver, platinum, palladium, etc. Examples of other useful silver-precipitating agents are heavy metal sulfides and selenides, in particular sulfides of mercury, copper, aluminum, zinc, cadmium, cobalt, nickel, silver, lead, antimony, bismuth, cerium, and magnesium, and selenides of lead, zinc, antimony, and nickel. (For the formation of a silver-precipitating agent, see, for example, U.S. Pat. No. 2,774,667.)

It is preferable in one embodiment of this invention to provide an acidic polymer layer which has the function of neutralizing the processing solution, between the image-receiving layer and its support. Preferable acidic polymers which can be used include copolymers of unsaturated carboxylic acids, such as acrylic acid, methacrylic acid, itaconic acid, and crotonic acid, and acidic cellulose derivatives. More specifically, butyl acrylate/acrylic acid copolymers, cellulose acetate hydrogen phthalate, ethyl methacrylate/methacrylic acid copolymers, and methyl methacrylate/methacrylic acid copolymers can be used. In addition to these, polymers containing sulfonic acid groups such as polystyrenesulfonic acid and acetalization products of polyvinyl alcohol and benzaldehyde-sulfonic acid can be used.

In order to prevent the processing solution adhering to the surface of the image-receiving layer when it is peeled off after the processing solution is spread over it, it is preferable to apply a stripping layer to the surface of the image-receiving layer. Examples of these stripping layers include gum arabic, hydroxyethylcellulose, methylcellulose, polyvinyl alcohol, sodium alginate, and also the stripping layers described in U.S. Pat. Nos. 3,772,024, and 3,820,999 and British Pat. No. 1,360,653.

In one special embodiment of this invention, it is possible to incorporate the image-receiving layer within the photosensitive element (i), as described below. For example, an image-receiving layer containing silver-precipitating nuclei, a light-reflecting layer containing a white pigment such as titanium dioxide, a light-shielding layer containing a light-absorbing substance such as carbon black, and a photosensitive silver halide emulsion layer are applied in that order to the surface of a polyethylene terephthalate sheet.

In this embodiment, it is possible to observe the image formed in the image-receiving layer through the polyethylene sheet because, after the diffusion transfer treatment, the rear layer can be shielded by the light-reflecting layer even if the photosensitive silver halide emulsion layer is not peeled off.

The photographic emulsion in this invention may contain any of the following as the silver halide: silver bromide, silver iodobromide, silver iodochlorobromide, silver chlorobromide, and silver chloride. A preferable silver halide is silver iodobromide or silver iodochlorobromide containing less than 10 mol% silver iodide. A particularly preferable silver halide is silver bromoiodide containing 3 to 10 mol% silver iodide.

Although the average grain size (defined as the grain diameter for spherical or nearly spherical grains, and the edge length for cubic grains, and specified by an average based on projected areas) is not particularly limited, it is preferably less than 3 microns, more preferably less than 1.5 microns, and even more preferably between 0.05 to 1.2 microns.

The distribution of grain sizes is not particularly limited.

When used in the silver salt diffusion transfer process, an emulsion comprising silver halide grains with no grains of a grain size of less than 0.5 micron is preferred.

The silver halide grains in the photographic emulsion may be of any of a variety of shapes, such as those having regular crystal forms such as cubic and octahedral, those having irregular crystal forms such as spherical and tubular, as well as combination of these crystal forms. They may consist of various shaped grains.

The interior of silver halide grains each may have a different phase than the surface layer. Alternatively, the silver halide grains may consist of a homogeneous phase. The silver halide grains may be those in which a latent image is formed chiefly on their surfaces, or may be those in which the latent image is formed chiefly within the grains. However, grains in which the latent image is formed on their surfaces are preferable.

The photographic emulsion used in this invention can be prepared by using processes described in *Chimie et Physique Photographique,* by P. Glafkides (published by Paul Montel Co., Ltd., 1967); *Photographic Emulsion Chemistry, by G. E. Duffin (published by The Focal Press,* 1966); *Making and Coating Photographic Emulsion,* by V. L. Zelikman, et al., (published by The Focal Press, 1964); etc., any acidic, neutral or ammonia method may be used, and when reacting a soluble silver salt with a soluble halogen salt, it is possible to use the single-jet method, double jet method, or a combination thereof. It is also possible to use a method in which grains are formed in the presence of an excess of silver ions (the so-called reverse mixing method). A method in which the pAg in the liquid phase in which the silver halide is formed is kept constant, that is, the so-called controlled double-jet method, can also be used as one form of the simultaneous mixing method.

According to this method, it is possible to provide a silver halide emulsion which has a regular crystal form and nearly uniform grain sizes. It is also possible to use a mixture of at least two silver halide emulsions which are formed separately.

During the formation of the silver halide grains or of their physical ripening, it is possible to use cadmium salts, zinc salts, lead salts, thallium salts, iridium salts or iridium complex salts, rhodium salts or rhodium complex salts, iron salts or iron complex salts, etc.

After precipitation or physical ripening, soluble salts are usually removed. As means for this, the well-known noodle washing process carried out after the gelation of gelatin may be used. A flocculation method utilizing an inorganic salt which has polyvalent anions (e.g., sodium sulfate), an anionic surfactant, an anionic polymer (such as polystyrenesulfonic acid), a gelatin derivative (such as an aliphatic-acylated gelatin or an aromatic-acylated gelatin) or the like can be used. It is also possible to omit the step of removing the soluble salts.

Although the silver halide emulsion may be one that is not subjected to chemical sensitization, i.e., a so-called primitive emulsion, it is usually a chemically sensitized emulsion. When performing the chemical sensitization, it is possible to use the methods described in the articles by Glafkides, Duffin and Zelikman, or that in *Grundlagen der Photographischen Prozesse mit Silverhalogenid-emulsionen,* by Frieser (Akademische Verlagnesellschaft, 1968).

The silver halide emulsion used in this invention may contain an antifoggant or a stabilizer. Compounds with such properties that can be used therefor are described in *Product Licensing Index* Vol. 92, p 107, "Antifoggants and stablizers".

The silver halide emulsion may contain a developing agent. Any of the developing agents described in *Product Licensing Index,* Vol. 92, pp 107–108, "Developing agents" can be used therefor.

The silver halide can be dispersed in a colloid which can be hardened by an organic or inorganic hardener. Any of the hardeners described in *Product Licensing Index,* Vol. 92, p 108, "Hardeners" can be used therefor.

The silver halide emulsion may contain a coating aid. Any of the coating aids described in *Product Licensing Index,* Vol. 92, p 108, "Coating aids" can be used therefor.

The silver halide emulsion may also contain an antistatic agent, a plasticizer, a brightening agent, an agent to prevent aerial fog, etc.

The silver halide emulsion used in this invention contains a vehicle which is described in *Product Licensing Index,* Vol. 92, p 108, "Vehicles" (December 1971).

The silver halide emulsion together with, if necessary, other photographic layers is applied to a support. Any of the methods of application described in Product Licensing Index, Vol. 92, p 109, "Coating Procedures" can be used therefor, and any of the supports described in *Product Licensing Index,* Vo. 92, p 108, "Supports" can be used.

In order to obtain an increased sensitivity, increased contrast, and accelerated developing, it is possible to add a substance such as a polyalkylene oxide or its ether, ester or amine derivatives, a thioether compound, a thiomorpholine, a quaternary ammonium salt compound, a urethane derivative, a urea derivative, an imidazole derivative, a 3-pyrazolidone, or the like, to the photographic emulsion of this invention. For example, the additives described in U.S. Pat. Nos. 2,400,532, 2,423,549, 2,716,062, 3,617,280, 3,772,021, 3,808,003, etc., can be used.

The photosensitive material prepared according to this invention may contain a water-soluble dye or another hydrophilic colloid layer acting as a filter dye, or for the purpose of preventing irradiation or the like. Examples of such dyes include oxonol dyes, hemioxonol dyes, styryl dyes, merocyanine dyes, cyanine dyes, and azo dyes. Of these dyes, merocyanine dyes such as oxonol dyes and hemioxonol dyes are useful. The dyes may be mordanted into a specific layer by a cationic polymer, such as dialkylaminoalkyl acrylate.

When the photosensitive material prepared according to this invention contains a dye, an ultraviolet ray absorber, or the like in a hydrophilic colloid layer, it may be mordanted with a cationic polymer or the like. It is possible to use, for example, the polymers described in British Pat. No. 684,475, U.S. Pat. Nos. 2,675,316, 2,839,401, 2,882,156, 3,048,487, 3,184,309 and 3,445,231. West German Offen-Legungs Schirift (OLS) No. 1,914,362, Japanese Patent Laid-Open Nos. 47624/1975 and 71,332/1975, etc.

The exposure for forming the photographic image may be done in the usual manner. Namely, it is possible to use any known light sources such as natural light (sunlight), tungsten lamps, fluorescent lamps, mercury vapor lamps, xenon arc lamps, carbon arc lamps, xenon lamps, the flying spot of a cathode-ray tube, etc. It is possible to use any of the exposure times from 1/1,000 to 1 sec which are usually used for camaras, as well as exposure times of less than 1/1,000 sec, such as exposure times of $1/10^4$ to $1/10^6$ sec, using a xenon flash lamp or cathode-ray tube, and also exposure times of longer than 1 sec. If desired, it is also possible to control the spectral energy distribution of the light used for the exposure with a color filter. It is also possible to use a laser beam for the exposure, or perform the exposure with light emitted from a fluorescent substance excited by electron beams, X-rays, $\gamma$-rays, etc. Arrangements and bonding methods used in combining the photosensitive element, image-receiving element and processing element to form a film unit, are described in, for example, *HANDBOOK OF PHOTOGRAPHY AND REPROGRAPHY*, by Neblettés, 7th ed., pages 282–285, and specific preferred embodiments thereof are described in detail in U.S. Pat. No. 3,350,991. Therefore, they can be used as references.

According to this invention, it is possible to increase and improve the toning effect of a silver image formed by the silver salt diffusion transfer process by using a compound of general formula (I) as a toning agent, and it is also possible to obtain an image by the silver salt diffusion transfer process with a high sensitivity, without affecting the toning effect, by using a compound of general formula (I) together with a compound of general formula (II).

This invention will now be described in more detail with reference to examples, but it should be understood that this invention is not limited to these examples.

EXAMPLE

An emulsion (of silver: 1.0 g/m$^2$) applied to a support was photographically exposed, and the image was developed by diffusion transfer by spreading a processing solution of the following composition so that a 50 $\mu$m-thick layer of the solution was formed between the emulsion and an image-receiving layer consisting of regenerated cellulose.

Processing solution:
Potassium hydroxide (40%): 323 ml
Titanium dioxide: 3 g
Hydroxyethylcellulose: 79 g
Zinc oxide: 9.75 g
Triethanolamine (45%): 17.14 g
N,N-Bis-methoxyethylhydroxylamine: 75 g
Uracil: 90 g
Water: 1193 ml Diffusion transfer development was performed in the same manner as described above, using a processing solution prepared by adding 0.02% by weight of the compound of this invention (general formula (I)) to the processing solution, or by using a processing solution prepared by adding a well-known compound, 1-phenyl-5-mercapto-1,2,3,4-tetrazole, as a comparative compound to the processing solution. The results are shown in Table 1.

TABLE 1

| | $R_1$ | $R_2$ | $D_{max}$ | Sensitivity (Reciprocal of exposure at D = 0.6) | Tone |
|---|---|---|---|---|---|
| Control | — | — | 1.40 | 100 | Red-brown (brown) |
| This invention | $-C_2H_5$ | 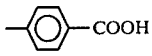 | 1.30 | 70 | Neutral tint (gray) |
| This invention | $-CH_3$ | $-SH$ | 1.20 | 80 | Neutral tint (gray) |
| This invention | $-CH_3$ | $-H$ | 1.40 | 50 | Neutral tint (gray) |
| This invention | $-CH_3$ | $-CH_3$ | 1.40 | 50 | Neutral tint (gray) |
| This invention | 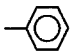 | $-CH_3$ | 1.25 | 30 | Neutral tint (gray) |
| Comparative Example | (0.001% by wt.) | | 0.80 | 120* | Light brown |
| | (0.02% by wt.) | | 0.15 | — | No image formed |

*Apparent value

Further, when 0.02% by weight of 3-mercapto-4,5-dimethyl-1,2,4-triazole was used in combination with 0.04% by weight of 6-n-propylthiouracil, the sensitivity was increased markedly, without any change in toning effect, such that $D_{max}$ became 1.40, and the sensitivity 150, while the neutral tints were retained. On the other hand, when 0.04% by weight of 6-n-propylthiouracil was used alone, the tone was red-brown, $D_{max}$ was 1.40, and the sensitivity was 120.

This results prove that the compounds of general formulas (I) and (II) according to this invention can exert a sufficient effect on tone and sensitivity.

What is claimed is:

1. In a process of forming an image by silver salt diffusion transfer comprising processing a photosensitive element provided with a layer of photosensitive silver halide emulsion on a support, and an image-receiving element provided with an image-receiving layer containing silver-precipitating nuclei on a support, with a processing composition containing an alkali, a hydroxylamine, and a silver halide solvent; a process of forming an image by silver salt diffusion transfer characterized in that said image-receiving element contains a compound represented by general formula (I) and a compound represented by general formula (II):

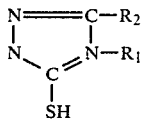

(I)

where $R_1$ is a hydrogen atom; and alkyl group of 1 to 6 carbon atoms which are not substituted or are substituted by halogens, $R_9CONH$— (where $R_9$ is an aryl group, or an alkyl group of 1 to 6 carbon atoms), or aryl groups; an alkenyl group of 1 to 6 carbon atoms; an aryl grpup; —SH; —$SR_4$ (where $R_4$ is an alkyl group of 1 to 3 carbon atoms); —OH; or —$N(R_5)_2$ (where $R_5$ is a hydrogen atom or an alkyl group of 1 or 2 carbon atoms); and $R_2$ is a hydrogen atom; an alkyl group of 1 to 6 carbon atoms which are not substituted or are substituted by halogens, $R_9CONH$— (where $R_9$ is an aryl group, or an alkyl group of 1 to 6 carbon atoms), or aryl groups; an alkenyl group of 1 to 6 carbon atoms; an aryl group; —$NH_2$; an aryl group which is substituted by $R_7CONH$— (where $R_7$ is an alkyl group of 1 or 2 carbon atoms), —$NO_2$, a halogen atom, $OR_8$ (where $R_8$ is an alkyl group with 1 or 2 carbon atoms), —COOH, or —$SO_3H$; —OH; —SH; or

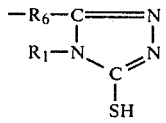

(where $R_6$ is an alkylene group of 2 to 6 carbon atoms); and

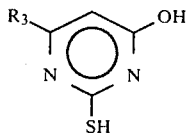

(II)

where $R_3$ is a hydrogen atom or an alkyl group of 1 to 6 carbon atoms.

2. The process of forming an image as set forth in claim 1, wherein the compound represented by said general formula (I) is

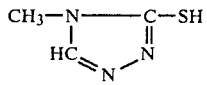

3. The process of forming an image as set forth in claim 1, wherein the compound represented by said general formula (I) is

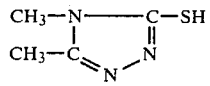

4. The process of forming an image as set forth in claim 1, wherein the quantity of the compound represented by said general formula (I) used is $10^{-8}$ to $10^{-3}M/m^2$.

5. The process of forming an image as set forth in claim 1, wherein the compound represented by said general formula (II) is 6-n-propylthiouracil.

6. The process of forming an image as set forth in claim 1, wherein the compound represented by said general formula (II) is 6-methylthiouracil.

7. The process of forming an image as set forth in claim 1, wherein the quantity of the compound represented by said general formula (II) used is $1\times10^{-6}$ to $1\times10^{-2}M/m^2$.

8. The process of forming an image as set forth in claim 1, wherein the compound represented by said general formula (I) is

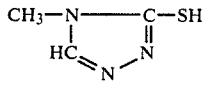

9. The process of forming an image as set forth in claim 1, wherein the compound represented by said general formula (I) is

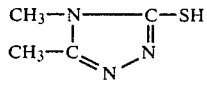

10. The process of forming an image as set forth in claim 1, wherein the quantity of the compound represented by said general formula (I) used is $1\times10^{-5}$ to $1\times10^{-1}M/l$.

11. In a process of forming an image by silver salt diffusion transfer comprising processing a photosensitive element provided with a layer of photosensitive silver halide emulsion on a support, and an image-receiving element provided with an image-receiving layer containing silver-precipitating nuclei on a support, with a processing composition containing an alkali, a hydroxylamine, and a silver halide solvent; a process of forming an image by silver salt diffusion transfer characterized in that said processing composition contains a compound represented by general formula (I) and a compound represented by general formula (II):

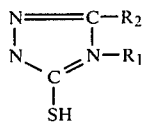

(I)

where $R_1$ is a hydrogen atom; an alkyl group of 1 to 6 carbon atoms which are not substituted or are substituted by halogens, $R_9CONH$— (where $R_9$ is an aryl group, or an alkyl group of 1 to 6 carbon atoms), or aryl groups; an alkenyl group of 1 to 6 carbon atoms; an aryl group; —SH; —$SR_4$ (where $R_4$ is an alkyl group of 1 to 3 carbon atoms); —OH; or —$N(R_5)_2$ (where $R_5$ is a hydrogen atom or an alkyl group of 1 or 2 carbon atoms); and $R_2$ is a hydrogen atom; an alkyl group of 1 to 6 carbon atoms which are not substituted or are substituted by halogens, $R_9CONH$— (where $R_9$ is an aryl group, or an alkyl group of 1 to 6 carbon atoms), or aryl groups; an alkenyl group of 1 to 6 carbon atoms; an aryl group; —$NH_2$; an aryl group which is substituted by $R_7CONH$— (where $R_7$ is an alkyl group of 1 or 2 carbon atoms), —$NO_2$, a halogen atoms, $OR_8$ (where $R_8$ is an alkyl group with 1 or 2 carbon atoms), —COOH, or —$SO_3H$; —OH; —SH; or

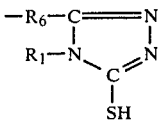

(where $R_6$ is an alkylene group of 2 to 6 carbon atoms), and

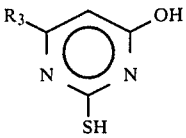

(II)

where $R_3$ is a hydrogen atom or an alkyl group of 1 to 6 carbon atoms).

12. The process of forming an image as set forth in claim 11, wherein the compound represented by said general formula (II) is 6-n-propylthiouracil.

13. The process of forming an image as set forth in claim 11, wherein the compound represented by said general formula (II) is 6-methylthiouracil.

14. The process of forming an image as set forth in claim 11, wherein the quantity of the compound represented by said general formula (II) used is $1\times10^{-5}$ to $10^{-1}$M/l.

15. In a process of forming an image by silver salt diffusion transfer comprising processing a photosensitive element provided with a layer of photosensitive silver halide emulsion on a support, and an image-receiving element provided with an image-receiving layer containing silver-precipitating nuclei on a support, with a processing composition containing an alkali, a hydroxylamine, and a silver halide solvent; a process of forming an image by silver salt diffusion transfer characterized in that said image-receiving element contains a compound of general formula (I), and said processing composition contains a compound of general formula (II):

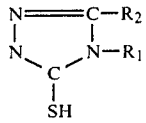

(I)

where $R_1$ is a hydrogen atom; an alkyl group of 1 to 6 carbon atoms which are not substituted or are substituted by halogens, $R_9CONH$— (where $R_9$ is an aryl group, or an alkyl group of 1 to 6 carbon atoms), or aryl groups; an alkenyl group of 1 to 6 carbon atoms; an aryl group; —SH; —$SR_4$ (where $R_4$ is an alkyl group of 1 to 3 carbon atoms); —OH; or —$N(R_5)_2$ (where $R_5$ is a hydrogen atom or an alkyl group of 1 or 2 carbon atoms); and $R_2$ is a hydrogen atom; an alkyl group of 1 to 6 carbon atoms which are not substituted or are substituted by halogens, $R_9CONH$— (where $R_9$ is an aryl group, or an alkyl group of 1 to 6 carbon atoms), or aryl groups; an alkenyl group of 1 to 6 carbon atoms; an aryl group; —$NH_2$; an aryl group which is substituted by $R_7CONH$— (where $R_7$ is an alkyl group of 1 or 2 carbon atoms), —$NO_2$, a halogen atom, $OR_8$ (where $R_8$ is an alkyl group with 1 or 2 carbon atoms), —COOH, or —$SO_3H$; —OH; —SH; or

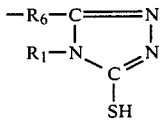

(where $R_6$ is an alkylene group of 2 to 6 carbon atoms), and

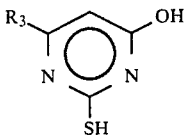

(II)

where $R_3$ is a hydrogen atom or an alkyl group of 1 to 6 carbon atoms.

16. In a process of forming an image by silver salt diffusion transfer comprising processing a photosensitive element provided with a layer of photosensitive silver halide emulsion on a support, and an image-receiving element provided with includes an image-receiving layer containing silver-precipitating nuclei on a support, with a processing composition containing an alkali, a hydroxylamine, and a silver halide solvent; a process of forming an image by silver salt diffusion transfer characterized in that said image-receiving element contains a compound of general formula (II), and said processing composition contains a compound of general formula (I):

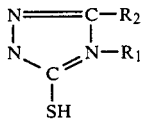

(I)

where $R_1$ is a hydrogen atom; an alkyl group of 1 to 6 carbon atoms which are not substituted or substituted with halogens, $R_9CONH$— (where $R_9$ is an aryl group or an alkyl group of 1 to 6 carbon atoms), or aryl groups; an alkenyl group of 1 to 6 carbon atoms; an aryl group; —SH; —$SR_4$ (where $R_4$ is an alkyl group of 1 to 3 carbon atoms); —OH; or —$N(R_5)_2$ (where $R_5$ is a hydrogen atom or an alkyl group of 1 or 2 carbon atoms); and $R_2$ is a hydrogen atom; an alkyl group of 1 to 6 carbon atoms which are not substituted or are substituted by halogens, $R_9CONH$— (where $R_9$ is an aryl group, or an alkyl group of 1 to 6 carbon atoms), or aryl groups; an alkenyl group of 1 to 6 carbon atoms; an aryl group; —$NH_2$; an aryl group which is substituted by $R_7CONH$— (where $R_7$ is an alkyl group of 1 or 2 carbon atoms), —$NO_2$, a halogen atom, $OR_8$ (where $R_8$ is an alkyl group with 1 or 2 carbon atoms), —COOH, or —$SO_3H$; —OH; —SH; or

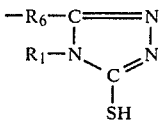

(where $R_6$ is an alkylene group of 2 to 6 carbon atoms), and

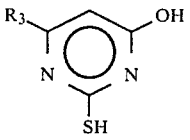

(II)

where $R_3$ is a hydrogen atom or an alkyl group of 1 to 6 carbon atoms.

* * * * *

UNITED STATES PATENT AND TRADEMARK OFFICE

CERTIFICATE OF CORRECTION

PATENT NO. : 4,526,857

DATED : July 2, 1985

INVENTOR(S) : Yoshio Idota

It is certified that error appears in the above-identified patent and that said Letters Patent is hereby corrected as shown below:

Col. 12, line 34, "claim 1" should read -- claim 11 --;

line 43, "claim 1" should read -- claim 11 --;

line 52, "claim 1" should read -- claim 11 --.

Signed and Sealed this

*Third* Day of *December 1985*

[SEAL]

*Attest:*

DONALD J. QUIGG

*Attesting Officer*

*Commissioner of Patents and Trademarks*